343-700 MS AU 251 EX
1/14/86 OR 4,564,842

United States Patent [19]
Suzuki

[11] Patent Number: 4,564,842
[45] Date of Patent: Jan. 14, 1986

[54] SINGLY FED CIRCULARLY POLARIZED MICROSTRIP ANTENNA

[75] Inventor: Yasuo Suzuki, Tokyo, Japan

[73] Assignee: Tokyo Shibaura Denki Kabushiki Kaisha, Kawasaki, Japan

[21] Appl. No.: 584,385

[22] Filed: Feb. 28, 1984

[30] Foreign Application Priority Data

Mar. 4, 1983 [JP] Japan ..... 58-35376

[51] Int. Cl.[4] ..... H01Q 1/38
[52] U.S. Cl. ..... 343/700 MS
[58] Field of Search ..... 43/700 MS, 829, 830

[56] References Cited

U.S. PATENT DOCUMENTS 3,984,834 5/1976 Kaloi ..... 343/700 MS
4,012,741 3/1977 Johnson ..... 343/700 MS

OTHER PUBLICATIONS

Haneishi et al., "A Design Method of Circularly Polarized Rectangular Microstrip Antenna by One-Point Feed," Electronics & Communications in Japan, vol. 64-B (1981) Apr., No. 4, pp. 46-54.
Richards et al., "An Improved Theory for Microstrip Antennas and Applications," IEEE Trans., vol. AP-29, Jan. 1981, pp. 38-46.
Kerr, "Microstrip Polarization Techniques", 1978 Symposium on Antenna Applications, University of Illinois, 20-22 Sep., pp. 1-17.
Long et al, "An Experimental Study of the Circular-Polarized Elliptical Printed Circuit Art.", IEEE Trans., vol. AP-29, No. 1, Jan. 1981, pp. 95-98.

*Primary Examiner*—Eli Lieberman
*Assistant Examiner*—Michael C. Wimer
*Attorney, Agent, or Firm*—Cushman, Darby & Cushman

[57] ABSTRACT

A singly fed circularly polarized microstrip antenna has a dielectric substrate having a ground layer coated on one side thereof and a metallic patch radiator coated on the other side thereof. The radiator takes any arbitrary configuration and excites circularly polarized waves at two frequencies. The feed point is located on the loci, determined by the exciting frequency and the circularly polarized wave rotation direction.

8 Claims, 18 Drawing Figures

SINGLY FED CIRCULARLY POLARIZED MICROSTRIP ANTENNA

BACKGROUND OF THE INVENTION

This invention relates to a singly fed circularly polarized microstrip antenna.

A microstrip antenna has numerous unique, attractive features such as a low profile, light weight and conformable structure. Research of the microstrip antenna has been conducted for practical application to a broader field, such as the field of antenna on a flying object such as aircraft or satellites. Here, the microstrip antenna is put to practical application mainly as a circularly polarized microstrip antenna. The circularly polarized microstrip antenna is classified into a singly fed and a dual fed type, depending upon the number of feed points necessary to excite the circular polarized waves. The singly fed type is very useful, because it requires no external circular polarizer.

The metallic patch radiator of the conventional singly fed circularly polarized (SFCP) microstrip antenna has, for example, a nearly square configuration, a square configuration having a slot or cutout on the diagonal line thereof, a circular configuration having a slot or cutout on one diameter thereof, or an elliptical configuration. One feature common among all the configurations is that they are limited to linear symmetry configurations. The feed point of the patch radiator is located on two straight lines intersected at an angle of ±45° with respect to the symmetrical axis and at an equidistant point of the symmetrical axis, i.e., located nearly on the two diagonal lines in the case of a rectangular configuration. In this case, the feed point, configuration and exciting frequency have been determined on a trial-and-error basis, requiring a lot of time and labor in the design of the antenna. A good circularly polarized wave was not excited with the conventional feed point. Furthermore, the exciting frequency is restricted to one frequency. The feature that the metallic path radiator has a linear symmetry configuration imposes a great restriction on the design of the antenna when the antenna is operated on a satellite in which weight and spatial room are restricted. Thus, the conventional singly fed circularly polarized microstrip antenna has involved various restrictions with respect to the configuration, exciting frequency, feed point etc.

SUMMARY OF THE INVENTION

An object of the invention is to provide a singly fed circularly polarized microstrip antenna of an arbitrary configuration having an excellent aspect ratio.

Another object of the invention is to provide a singly fed circularly polarized microstrip antenna having an arbitrary configuration free from a linear symmetry configuration and a feed point whose position is arbitrarily determined.

A further object of the invention is to provide a singly fed circularly polarized microstrip antenna of an arbitrary configuration which is excited in an arbitrary frequency.

According to this invention, there is provided a singly fed circularly polarized microstrip antenna comprising an dielectric substrate, a conducting ground layer coated on one side of said dielectric substrate, and a conducting patch radiator coated on the other side of said dielectric substrate, the radiator having a feed point ($x_c$, $y_c$) which is a solution of the following equation $$\frac{\psi^{(\nu+1)}(x_o\ y_c)}{\psi^{(\nu)}(x_o\ y_c)} = \pm \frac{E_0^{(\nu)}(0,\omega_c)\cdot\hat{x}}{E_0^{(\nu+1)}(0,\omega_c)\cdot\hat{y}} \times \left\{\omega_c C - \frac{1}{\omega_c L^{(\nu+1)}}\right\} \quad (+: RHCP,\ -: LHCP)$$

where $\nu$, $\nu+1$ represent two orthogonal modes contributing a circularly polarized wave;

$\psi^{(\nu)}$ represents an eigenfunction with respect to a $\nu$-th mode determined by the dimensions of the radiator and which is a function with respect to the position (x, y);

$E_0^{(\nu)}(0, \omega_c)$ represents an electric field in a direction $\theta=0°$ with respect to the $\nu$-th mode;

C represents a capacitance component of an equivalent circuit parameter for a microstrip antenna;

$L^{(\nu)}$ represents an inductance component of an equivalent circuit parameter for a microstrip antenna; and $\omega_c$ is an exciting frequency which is a $(\mu+1)$-th solution of the following interative equation:

$$\omega_{\mu+1} = \sqrt{\frac{[\{(\omega^{(\nu)})^2 + (\omega^{(\nu+1)})^2\} - U^2(\omega_\mu)] \pm \sqrt{D(\omega_\mu)}}{2}}$$

$$\text{where } D(\omega) = [\{\omega^{(\nu)} - \omega^{(\nu+1)}\}^2 - U^2(\omega)] \times [\{\omega^{(\nu)} + \omega^{(\nu+1)}\}^2 - U^2(\omega)],$$

$$U(\omega) = \frac{\sqrt{g^{(\nu)}(\omega)\cdot g^{(\nu+1)}(\omega)}}{C},$$

$g^{(\nu)}(\omega)$: a conductance component of an equivalent circuit parameter for a microstrip antenna, which is a function with respect to $\omega$.

DETAILED DESCRIPTION OF THE PREFERRED EMBODIMENTS

A singly fed circularly polarized microstrip antenna according to this invention will be described by referring to the accompanying drawings.

Figure 1A:
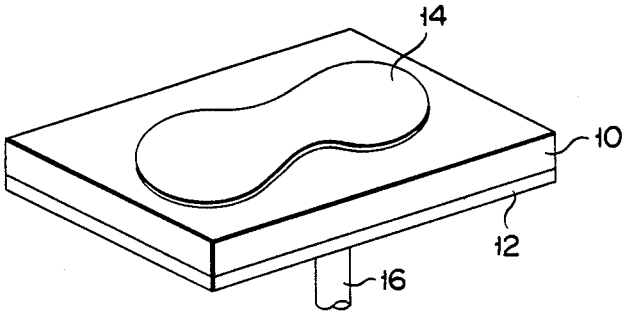
FIGS. 1A and 1B are a perspective view and cross-sectional view of a singly fed circularly polarized microstrip antenna having a radiator of an arbitrary configuration according to one embodiment of this invention.
Figure 1B:
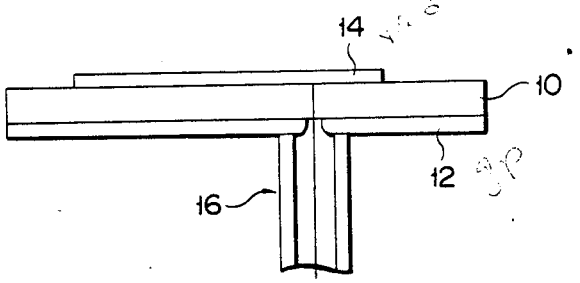

FIGS. 1A and 1B are a perspective view and cross-sectional view, of a singly fed circularly polarized microstrip antenna according to one embodiment of this invention. The antenna comprises a dielectric substrate 10 coated on one side with a highly conducting ground layer 12 and on the other side with a highly conducting metallic patch radiator 14. The radiator 14 may take any arbitrary configuration. The radiator 14 is fed by a coaxial probe 16 from the side of the ground layer 12, but may be fed by a microstrip line formed integral with the radiator 14. In the former case, a central conductor is connected through the dielectric substrate 10 to one point, i.e., a feed point on the radiator 14.

The feed point and exciting frequency with which a circularly polarized wave is excited will be determined as set out below. Hereinafter, the exciting frequency will be called a circularly polarized (CP) operating frequency.

Figure 2:
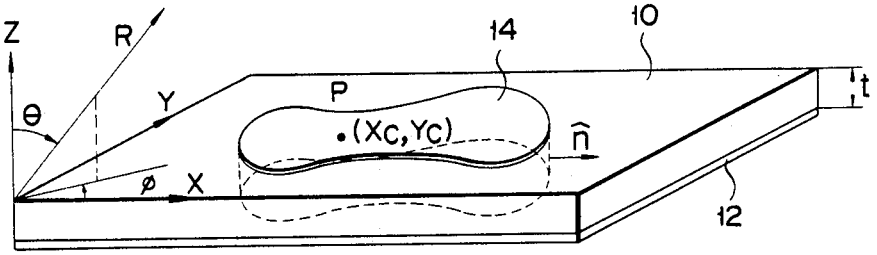
FIG. 2 is a view showing a coordinate system for analyzing a radiation pattern of the microstrip antenna.

Standard spherical coordinates (R, $\theta$, $\phi$) are defined as shown in FIG. 1. Here, the dielectric substrate 10 is square in configuration with the horizontal and vertical axes as X- and Y-axes and the thickness axis as a Z axis. In FIG. 2, the coaxial probe 16 is omitted. Here, the boundary of the patch radiator 14 is represented by P. In FIG. 2, t shows a substrate thickness; $\epsilon_r$, a dielectric constant of the substrate; and $\hat{n}$, a unit vector normal to the boundary P.

Since, in practice, the substrate thickness t is electrically thin, the Z component in the electric field and X and Y components in the magnetic field exist in the region bounded by the radiator 14 and the ground layer 12. Where the microstrip antenna has an arbitrarily defined boundary, the eigenfunctions and eigenvalues can be calculated under the assumption of the Neumann boundary conditions by employing the variational method. The assumption for the Neumann boundary conditions may be approximately corrected by considering the edge extension for fringing field effects. Once they are known, the antenna parameters can be derived straightforwardly. That is, when the position ($x_c$, $y_c$) is selected as a feed point, a total radiation field measured in the $\theta$ direction is given by:

$$E(\theta) = \sum_{m=1}^{\infty} \Omega^{(m)}(x_o y_c) E_0^{(m)}(\theta,\omega) \tag{1}$$

where $$E_0^{(m)}(\theta,\omega) = 120\pi H_0^{(m)}(\theta,\omega) \times \hat{R} \tag{2}$$

-continued $$H_0^{(m)}(\theta,\omega) = \frac{-j\omega\epsilon_0}{4\pi} t\left\{ 2\cos\left(\frac{k_0 t}{2}\cos\theta\right) \phi_P(\hat{n} \times \hat{Z})\psi^{(m)}(x,y) \cdot exP\{jk_0(x\cos\phi + y\sin\phi)\sin\theta\} dl \right. \tag{3}$$

where $\omega$ denotes an exciting angular frequency;

$k_0$ denotes a free-space wave number;

$\psi^{(m)}$ represents the eigenfunction for the m-th mode; and $\hat{R}$ and $\hat{Z}$ represent unit vectors in the R and Z directions, respectively. In the case of the square configuration, the eigenfunction for a basic mode (m=1) can be easily obtained by a variable separation method and expressed by $$\psi^{(1)} = \frac{1}{h}\left(\sin\frac{\pi}{h}x + \cos\frac{\pi}{h}y\right)$$

where h represents the length of one side of the square configuration.

The integral in Equation (3) must be numerically integrated along the patch boundary P. In Equation (1), $\Omega^{(m)}$ means the mode amplitude coefficient for the m-th mode and is given by:

$$\Omega^{(m)}(x_o y_c) = \frac{\sqrt{2}\,S}{t} \frac{\psi^{(m)}(x_o y_c)}{Y^{(m)}(\omega)} I(x_o y_c), \tag{4}$$

where $I(x_c, y_c)$ denotes the input current at the point ($x_c$, $y_c$).

An admittance $Y^{(m)}$ can be expressed as a general network representation.

$$Y^{(m)}(\omega) = j\left(\omega C - \frac{1}{\omega L^{(m)}}\right) + g^{(m)}(\omega) \tag{5}$$

where the conductance $g^{(m)}(\omega) = g_c^{(m)}(\omega) + g_d^{(m)}(\omega) + g_r^{(m)}(\omega)$ (6)

the capacitance $C = \frac{\epsilon_0\epsilon_r}{t} S$ (7)

the resonant angular frequency $\omega^{(m)} = \frac{k^{(m)}}{\sqrt{\epsilon_r\epsilon_0\mu_0}}$ (8)

the inductance $L^{(m)} = \frac{1}{(\omega^{(m)})^2 C}$ (9)

$$g_c^{(m)}(\omega) = \frac{2R_s}{t\mu_0}\left(\frac{\omega^{(m)}}{\omega}\right)^2 C \tag{10}$$

$$g_d^{(m)}(\omega) = \omega C \tan\delta \tag{11}$$

$$g_r^{(m)}(\omega) = \frac{S}{t^2} R_e\{\int\int(E_0^{(m)*} \times H_0^{(m)}) \cdot \hat{R}\sin\theta\, d\theta d\phi\} \tag{12}$$

where $k^{(m)}$ represents an eigenvalue for the m-th mode;

Rs shows the real part of the surface impedance for the metallic patch radiator and the ground layer; and tan $\delta$ represents the loss tangent for the dielectric substrate.

In Equation (12), Re {A} denotes the real part of A (a complex value) and the asterisk * denotes the complex conjugate.

The general characteristic of the circularly polarized field will be described below.

A microstrip antenna must have a pair of orthogonally polarized modes within the cavity region in order to radiate the CP wave. If the contributions from all of the nonresonant modes are ignored, except those for the two desired modes, the total radiation field, which is a function of direction $\theta$ and angular frequency $\omega$ may be written as follows:

$$E(\theta)=\{\Omega^{(\nu)}(x_o\ y_c)E_0^{(\nu)}(\theta,\omega)+\Omega^{(\nu+1)}(x_o\ y_c)E_0^{(\nu+1)}(\theta,\ \omega)\} \tag{13}$$

where $(x_c,\ y_c)$ is a feeding point and $\Omega^{(\nu)}$ and $E_0^{(\nu)}$ are given by Eq. (4) and Eq. (2), respectively. In the above equation, the $\nu$-th and $(\nu+1)$-th modes are chosen as the desired orthogonal modes. Here, if the coordinate system is chosen so that the X-axis coincides with the direction of the $\nu$-th bore-sight field $E_0^{(\nu)}(0,\ \omega)$ and the Y-axis coincides with the direction of the $(\nu+1)$-th bore-sight field $E_0^{(\nu+1)}(0,\ \omega)$, the far field given by Eq. (13) is expressed at bore-sight as $$E(0)=E_x\hat{x}+E_y\hat{y} \text{ at } \theta=0 \tag{14}$$

where $$E_x=E(0)\cdot\hat{x}=\Omega^{(\nu)}(x_o\ y_c)E_0^{(\nu)}(0,\ \omega)\cdot\hat{x} \tag{15}$$

$$E_y=E(0)\cdot\hat{y}=\Omega^{(\nu+1)}(x_o\ y_c)E_0^{(\nu+1)}(0,\ \omega)\cdot\hat{y} \tag{16}$$

with x and y being unit vectors in the X and Y directions, respectively. Eq. (14) can also be modified as follows:

$$E(0)=E_L(x+jy)+E_R(x-jy), \tag{17}$$

where $E_R$ and $E_L$ denote the right hand and left hand CP components, respectively and these are written as $$E_L=\frac{1}{2j}(jE_x+E_y)=\frac{1}{2}\{\Omega^{(\nu)}(x_o\ y_c)E_0^{(\nu)}(0,\ \omega)\cdot\hat{x}-j\Omega^{(\nu+1)}(x_c\ y_c)E_0^{(\nu+1)}(0,\ \omega)\cdot\hat{y}\} \tag{18}$$

and $$E_R=\frac{1}{2j}(jE_x-E_y)=\frac{1}{2}\{\Omega^{(\nu)}(x_o\ y_c)E_0^{(\nu)}(0,\ \omega)\cdot\hat{x}+j\Omega^{(\nu+1)}(x_o\ y_c)E_0^{(\nu+1)}(0,\ \omega)\cdot\hat{y}\} \tag{19}$$

Accordingly, from $E_L=0$ or $E_R=0$, the following equation is given.

$$\frac{\Omega^{(\nu+1)}(x_oy_c)E_0^{(\nu+1)}(0,\omega)\cdot\hat{y}}{\Omega^{(\nu)}(x_oy_c)E_0^{(\nu)}(0,\omega)\cdot\hat{x}}=\mp j\begin{cases}\text{for } E_L=0\\ \text{for } E_R=0\end{cases} \tag{20}$$

When the above equation is satisfied, the field given by (17) becomes CP wave and is expressed as $$E(0)=\Omega^{(\nu)}(x_oy_c)E_0^{(\nu)}(0,\omega)\cdot\hat{x}(x\mp j\hat{y})\begin{cases}RHCP\\ LHCP\end{cases} \tag{21}$$

where RHCP and LHCP mean the right hand and left hand circular polarization respectively.

A microstrip antenna may become an SFCP antenna when its dimensions are adjusted to suitable values, as described above. In addition, when the operating frequency and feed point are chosen correctly, a good CP wave is radiated. The frequency at which a good CP wave is excited is called the CP operating frequency. This section indicates how the CP operating frequency and the corresponding optimum feed point are derived.

Substituting Eq. (4) into Eq. (20), the following expression is given.

$$\frac{\psi^{(\nu+1)}(x_oy_c)}{\psi^{(\nu)}(x_oy_c)}\ \frac{j\left(\omega C-\frac{1}{\omega L^{(\nu)}}\right)+g^{(\nu)}(\omega)}{j\left(\omega C-\frac{1}{\omega L^{(\nu+1)}}\right)+g^{(\nu+1)}(\omega)}=\mp j\frac{E_0^{(\nu)}(0,\omega)\cdot\hat{x}}{E_0^{(\nu+1)}(0,\omega)\cdot\hat{y}}\begin{cases}\text{for } RHCP\\ \text{for } LHCP\end{cases} \tag{22}$$

Comparing the coefficients for the real parts and for the imaginary parts on the both sides of the above complex equation, respectively, the following simultaneous equations are obtained.

$$g^{(\nu)}(\omega)=\pm\frac{B(\omega)}{\beta(x_oy_c)}\left\{\omega C-\frac{1}{\omega L^{(\nu+1)}}\right\},\begin{cases}\text{for } RHCP\\ \text{for } LHCP\end{cases} \tag{23}$$

$$-\left\{\omega C-\frac{1}{\omega L^{(\nu)}}\right\}=\pm\frac{B(\omega)}{\beta(x_oy_c)}g^{(\nu+1)}(\omega),\begin{cases}\text{for } RHCP\\ \text{for } LHCP\end{cases} \tag{24}$$

$$\because\ \beta(x_oy_c)=\frac{\psi^{(\nu+1)}(x_oy_c)}{\psi^{(\nu)}(x_oy_c)}, \tag{25}$$

$$\because\ B(\omega)=\frac{E_0^{(\nu)}(0,\omega)\cdot\hat{x}}{E_0^{(\nu+1)}(0,\omega)\cdot\hat{y}} \tag{26}$$

where $B(\omega)$ is a real number at $\theta=0$, since $E_0^{(m)}(0,\ 107)$ are real numbers in Eqs. (2), (3) because $\psi^{(m)}$ are real eigenfunctions in this theory. Therefore, eliminating $\pm B/\beta$ from Eqs. (23), (24) yields the following governing equation from which the CP operating angular frequency $\omega_c$ can be determined.

$$\omega^4+\omega^2[U^2(\omega)-\{(\omega^{(\nu+1)})^2+(\omega^{(\nu)})^2\}]+\{\omega^{(\nu)}\cdot\omega^{(\nu+1)}\}^2=0, \tag{27}$$

$$\because\ \sqrt{CL^{(m)}}=1/\omega^{(m)}$$

where $$U(\omega)=\frac{\sqrt{g^{(\nu)}(\omega)g^{(\nu+1)}(\omega)}}{C}. \tag{28}$$

The solutions of the governing equation (27) are given by $$\omega=\sqrt{\frac{[\{(\omega^{(\nu)})^2+(\omega^{(\nu+1)})^2\}-U^2(\omega)]\pm\sqrt{D(\omega)}}{2}}\quad(\geqq 0) \tag{29}$$

where $$D(\omega)=[\{\omega^{(\nu)}-\omega^{(\nu+1)}\}^2-U^2(\omega)][\{\omega^{(\nu)}+\omega^{(\nu+1)}\}^2-U^2(\omega)]\geqq 0 \tag{30}$$

Eq. (29) shows that Eq. (27) has two significant roots because of $\omega\geqq 0$, provided that the following CP operating condition, derived from inequality of Eq. (30), is satisfied.

$$|\omega^{(\nu)}-\omega^{(\nu+1)}|\geqq U(\omega). \tag{31}$$

Physically, this implies that it is possible for an singly fed CP antenna to produce the good CP waves at two slightly separate frequencies. However, if Eq. (31) is not satisfied, the good CP waves cannot be produced from such antenna. In Eq. (29), the CP operating frequencies are functions of conductance components and resonant frequencies. The conductance components, in general, are a function of operating frequency. Accordingly, the CP operating frequencies must be determined through an iterative process. Using the $\mu$-th iterative solution $\omega_\mu$, the $(\mu+1)$-th solution is given by $$\omega_{\mu+1}=\sqrt{\frac{[\{(\omega^{(\nu)})^2+(\omega^{(\nu+1)})^2\}-U^2(\omega_\mu)]\pm\sqrt{D(\omega_\mu)}}{2}}\ , \tag{32}$$

The satisfactory convergence for (32) is obtained ordinarily by about three iterations, because the conductance components are not a strong function of frequency near the resonances of the desired modes.

When it is desired to design a good SFCP antenna, the correct choice of the feeding point is also very important. All of the optimum feed point loci are determined numerically by substituting the convergence results of Eq. (32) into Eq. (23), because the resulting equation becomes a function of feeding point ($x_c$, $y_c$).

Also, if the equality in Eq. (30) is satisfied, the solution for Eq. (27) is given by $$\omega=\sqrt{\omega^{(\nu)}\omega^{(\nu+1)}}\ . \tag{33}$$

In this case, it can be seen that only one CP operating frequency is given by the geometric means of two resonant frequencies.

According to this invention, if the eigenfunction $\psi^{(m)}$ which gives the radiator configuration is determined, the CP operating frequency and feed point are determined from Equations (32) and (23), respectively, realizing a singly fed circularly polarized microstrip antenna. Although the CP operating frequency has been first determined, the feed point may be first determined through the elimination of $\omega_c$ in solving the simultaneous equations, i.e., Equations (23) and (24). The radiation configuration may be determined after the CP operating frequency and feed point have been determined.

To prove the validity of the above-mentioned theory the antenna was actually manufactured and comparison was effected between the theoretical values and the measured values. Here, it is assumed that a dielectric substrate 10 with a thickness t of 3.2 mm, nominal dielectric constant $\epsilon_r$ of 2.55 and loss tangent tan $\delta$ of about 0.0018 was made of copper-clad Teflon fiberglass fed by the coaxial probe.

As one form of design, a microstrip antenna having a nearly square radiator with the dimensions a×b (a=100 mm) will be explained below.

Figure 3:
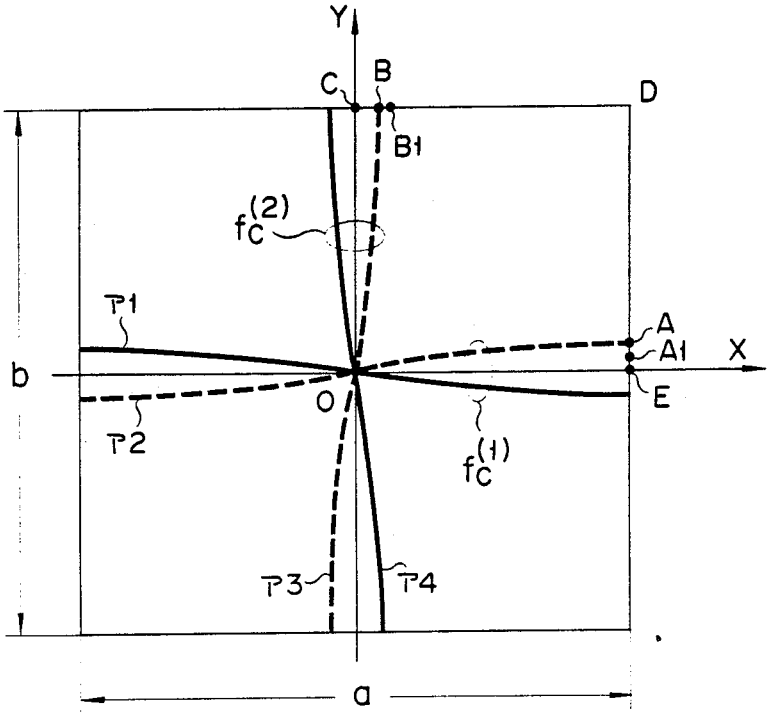
FIG. 3 shows the loci of the feed point of the microstrip antenna having a nearly square radiator with an aspect ratio of 0.95.

FIG. 3 shows a plan view of the antenna radiator and loci $\Gamma_1$ to $\Gamma_4$ of theoretical feed points obtained from Equation (23), noting that b/a=0.95, $\Gamma_1$, $\Gamma_2$ show the loci when $f_c^{(1)}$ (CP operating frequency)=953.47 MHz and $\Gamma_3$, $\Gamma_4$ show the loci when $f_c^{(2)}$=907.48 MHz. $\Gamma_1$, $\Gamma_4$ as indicated by the solid line show the loci of the feed point for RHCP and $\Gamma_2$, $\Gamma_3$ as indicated by the broken line show the loci of the feed point for LHCP. That is, if a feed current of 953.47 MHz is supplied to one point on $\Gamma_1$, $\Gamma_2$, a circularly polarized wave of 953.47 MHz is excited, while if a feed current of 907.48 MHz is supplied on one point on $\Gamma_3$, $\Gamma_4$, a circularly polarized wave of 907.48 MHz is excited. In practice, there is some case where the position of the feed point is deviated from a theoretical value due to the dimensions of the radiator or due to the mutual coupling between radiators in the case of an array antenna. In practice, therefore, the feed point is determined such that it somewhat varies with respect to the theoretical point of $\Gamma_1$ to $\Gamma_4$. Therefore, the position of the actual feed point may be somewhat deviated from the theoretical locus.

Figure 4:
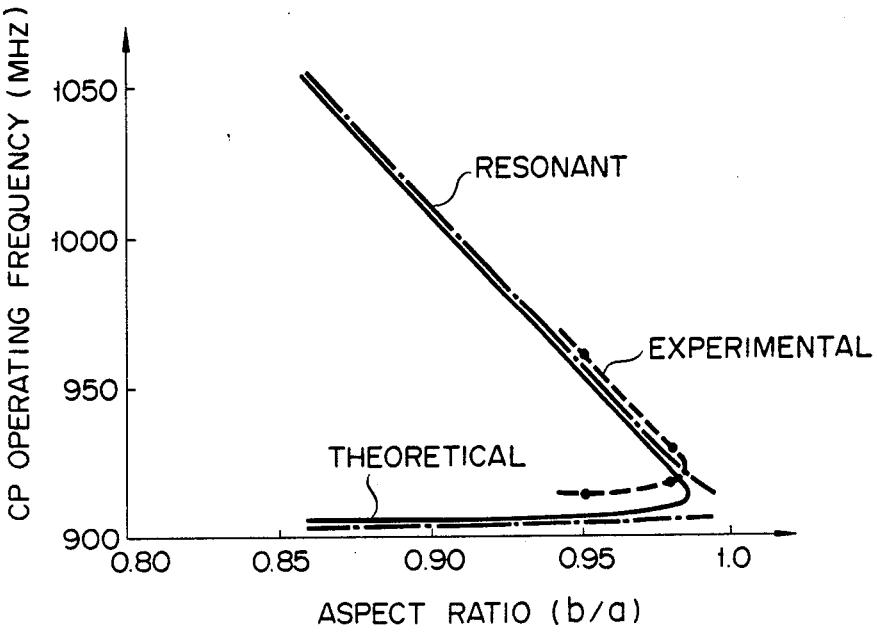
FIG. 4 is a graph showing a relation of the CP operating frequency to the aspect ratio of the nearly square antenna with t=3.2 mm, $\epsilon_r$=2.55 and a=100 mm.

It has been believed up to this time that this antenna can produce a good CP wave with a single feed only when the aspect ratio is adjusted to Q/(Q+1); (Q is a Q factor of a microstrip antenna), the operating frequency is chosen to be $$\frac{1}{2B\sqrt{\epsilon_r\epsilon_0\mu_0}}$$

and the feeding point is attached at a location on the diagonal. From FIG. 3 it will be seen that the locus of the feed point is located on a vertical bisecting line of each side, not on the diagonal when the aspect ratio is 0.95. Equation (29) indicates that the singly fed CP antenna, in general, can produce two CP waves for various aspect ratios as long as they are chosen to satisfy the CP operating condition in Equation (31). To investigate changes in two CP operating frequencies with respect to the aspect ratio, Equation (29) is solved for various aspect ratios. FIG. 4 shows a comparison between the CP operating frequencies and the aspect ratio, where the solid line represents the theoretical result, the broken line shows the experimental result and the dot dash line shows the calculated resonant frequencies for two desired orthogonal modes. As expected, these results show that the two CP operating frequencies can be theoretically predicted with good accuracy where the aspect ratio is smaller than 0.99. Now suppose that 0.95 is selected as the aspect ratio. In this case, it is predicted from the theoretical result that two CP waves may be excited at 907.48 MHz and 953.47 MHz, while the experimental result shows that those are actually excited at 914.9 MHz and 959.0. In order to obtain a good CP wave, the singly fed CP antenna must be fed at such a position as to make the amplitudes equal for two radiation fields, due to the desired orthogonal modes.

Figure 5A:
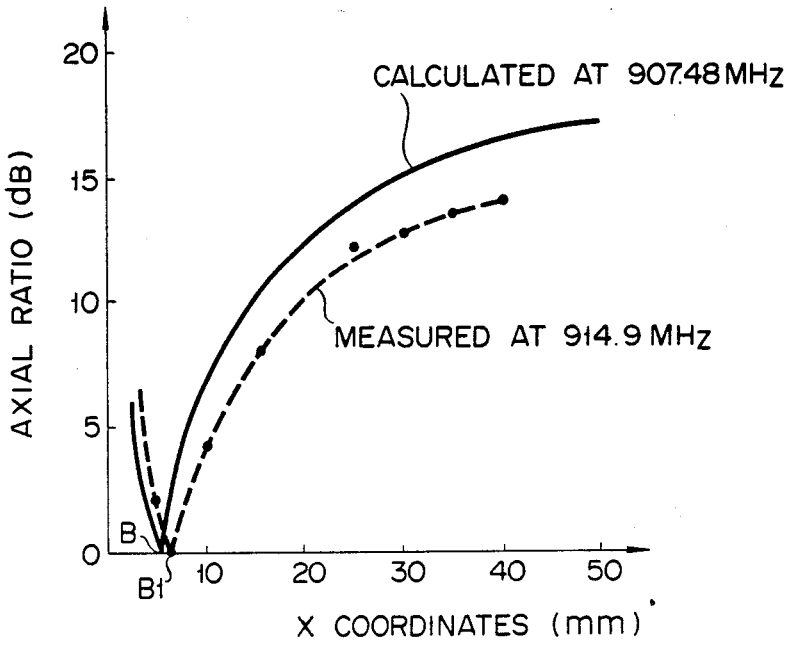
FIGS. 5A and 5B are graphs showing a relation of the axial ratio to the feed point of the antenna of FIG. 3.
Figure 5B:
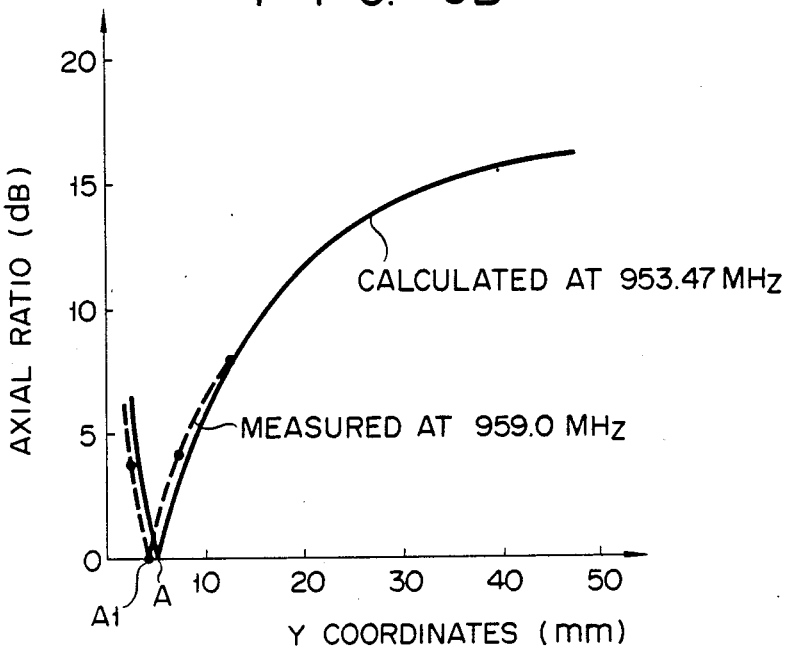

FIGS. 5A and 5B show the relations between the axial ratio and the feed point for the aspect ratio of 0.95. FIG. 5A shows a change of the axial ratio caused by moving the feed point from C to D in FIG. 3. FIG. 5B shows a change of the axial ratio moving the feed point from E to D. From the calculated axial ratio it is found that pure CP waves can be radiated by feeding at the point A or B for each CP operating frequency. In these Figures, the measured data are also shown as a broken line. Measurement shows that two individual optimum CP waves can be obtained by feeding at the point A1 and B1, where positions are nearly equal to those for A and B, respectively. In this case, if the point D is selected as a feed point, the 15 dB axial ratio is extrapolated at 914.9 MHz so that the CP antenna circularity is not quite satisfactory.

Figure 6A:
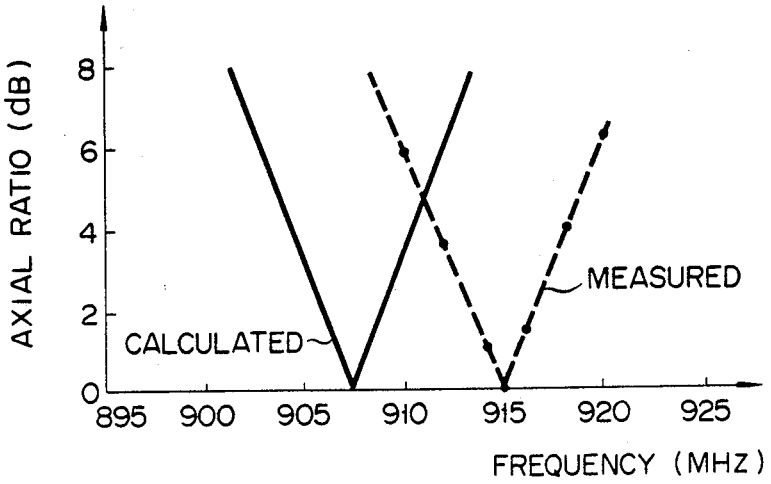
FIGS. 6A and 6B show the frequency characteristic of the antenna of FIG. 3 with respect to the axial ratio when the feed point is at B and A.
Figure 6B:
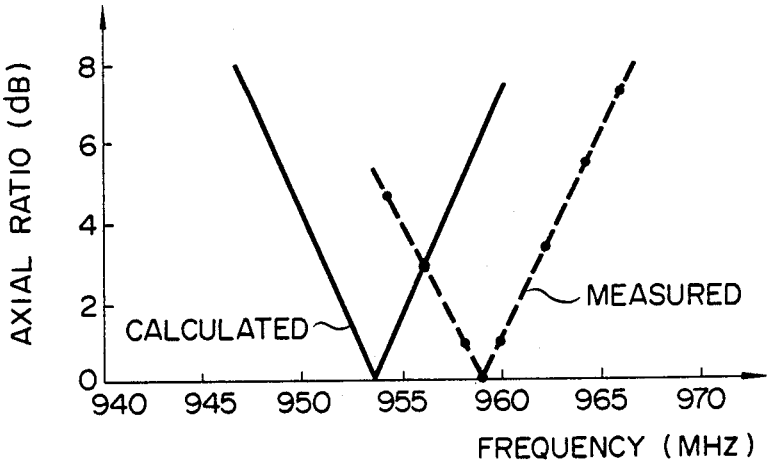

Since agreement is very good between the calculated and measured results, axial ratios were calculated as a function of frequency for both point A-fed case and point B-fed case, where the first twenty modes are considered to get more exact results at nonresonant frequencies. The results are shown with those measured by selecting points B1 and A1 respectively as feed points in FIGS. 6A and 6B. It can be seen, from these Figures, that excellent CP waves are obtained and that the bandwidth for 3 dB axial ratio is about 0.5%. The agreement between calculated and measured results is excellent, except for a difference in the CP operating frequency of about 6 MHz (0.6%). Here, there is some case where the CP operating frequency may be somewhat deviated from the theoretical value. In practice, therefore, the operating frequency may be determined such that it is somewhat varied from the theoretical value.

As will be appreciated from the above, a singly fed circularly polarized microstrip antenna with a square radiator can be readily manufactured according to this invention. Even in the same antenna, the circularly polarized waves of different frequencies can be excited by shifting the position of the feed point from $\Gamma_1$, $\Gamma_2$ to $\Gamma_3$, $\Gamma_4$.

A microstrip antenna with a pentagonal radiator will be explained as a second form of design.

Figure 7:
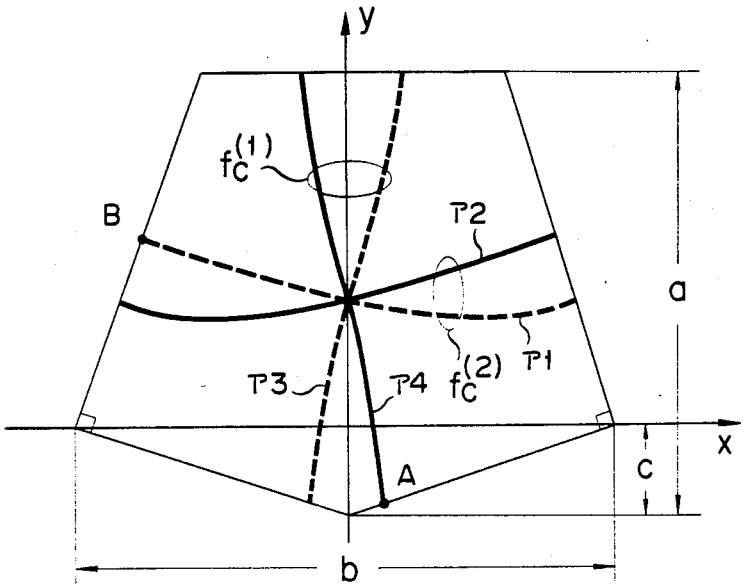
FIG. 7 shows the loci of the feed point of the microstrip antenna having a pentagonal radiator with a=100 mm, b/a=1.2, c/a=0.2, t=3.2 mm and $\epsilon_r$=2.55.

FIG. 7 shows a plan view of the radiator, as well as the loci $\Gamma_1$ to $\Gamma_4$ of the theoretical feed point obtained from Equation (23), where a=100 mm and b/a=1.2. In FIG. 7, $\Gamma_1$, $\Gamma_2$ show the loci when the CP operating frequency $f_c^{(2)}$ is 1006.0 MHz and $\Gamma_3$, $\Gamma_4$ show the loci when the CP operating frequency $f_c^{(1)}$ is 973.79 MHz, noting that $\Gamma_1$, $\Gamma_4$ as indicated by the solid line correspond to RHCP and $\Gamma_2$, $\Gamma_3$ as indicated by the broken line correspond to LHCP. That is, when a feeding current of 1006.0 MHz is fed to one point on $\Gamma_1$, $\Gamma_2$, a CP wave of 1006.0 MHz is excited. On the other hand, when a feeding current of 973.79 MHz is supplied to one point on $\Gamma_3$, $\Gamma_4$, a CP wave of 973.79 MHz is excited.

Figure 8:
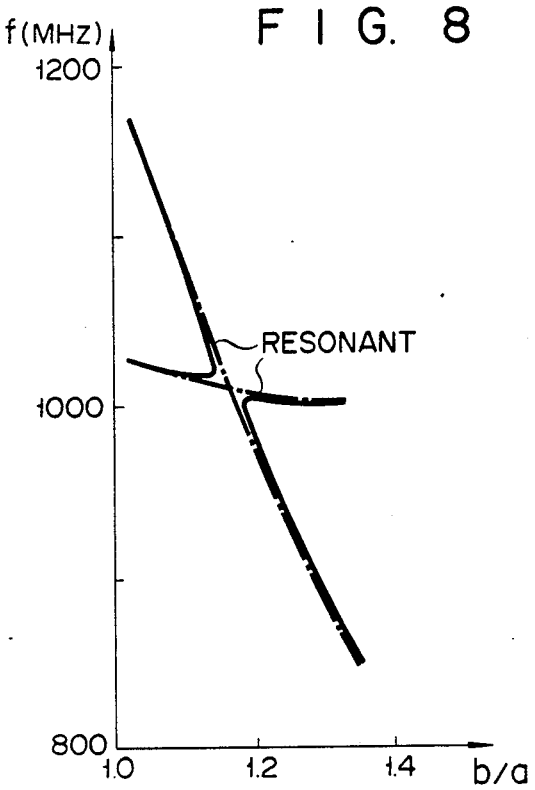
FIG. 8 is a graph showing a variation in the CP operating frequency when the antenna configuration of FIG. 7 is varied.

The solid line as shown in FIG. 8 shows a variation of CP operating frequency when b/a in FIG. 7 is varied, noting that the dot-dash line denotes the resonant frequencies of two modes contributing to the CP wave. From FIG. 8 it will be noted that CP waves are excited at two frequencies when b/a is smaller than 1.15 or greater than 1.17.

Figure 9A:
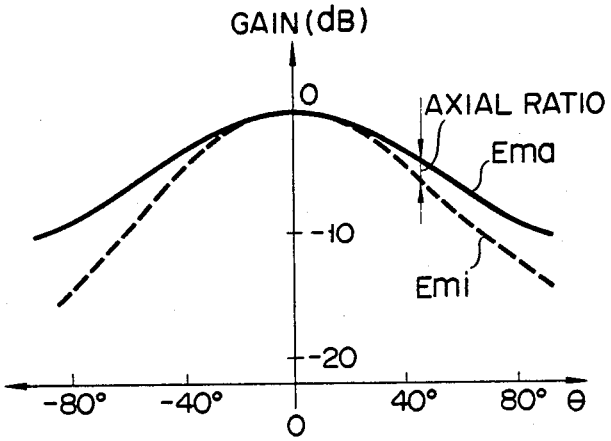
FIGS. 9A and 9B are graphs showing the wide-angle axial ratio characteristic of the antenna of FIG. 7.
Figure 9B:
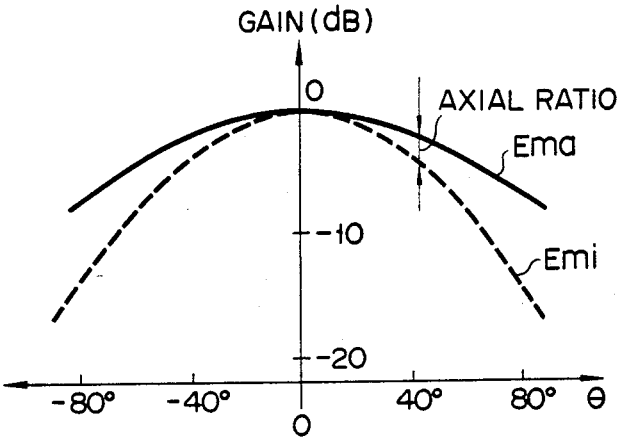

FIGS. 9A and 9B show the wide-angle axial ratio characteristic of the antenna in FIG. 7, noting that FIG. 9A corresponds to the case where one point A on the locus $\Gamma_4$ is defined as the feed point while FIG. 9B corresponds to the case where one point B on the locus $\Gamma_1$ is defined as the feed point. The characteristic correspond to the axial ratio with respect to the respective $\theta$ in the Z-X plane in the coordinates in FIG. 2. In these Figures, Ema as indicated by the solid line shows a maximum value of the elliptically polarized electric field and Emi as indicated by the broken line shows a minimum value of the elliptically polarized electric field, noting that a difference Ema-Emi shows the axial ratio. From these Figures it will be appreciated that, when $\theta=0$ the axial ratio is zero and pure CP waves are excited in the Z-axis direction. It is needless to say that such a wide-angle axial ratio characteristic can be established not only at the points A, B but also any point of $\Gamma_1$ to $\Gamma_4$. In this form of design, there is some case where, like the first form of design, the CP operating frequency and feed point need to be somewhat adjusted from the theoretical values.

A microstrip antenna with an isosceles triangle radiator will be explained as a third form of design.

Figure 10:
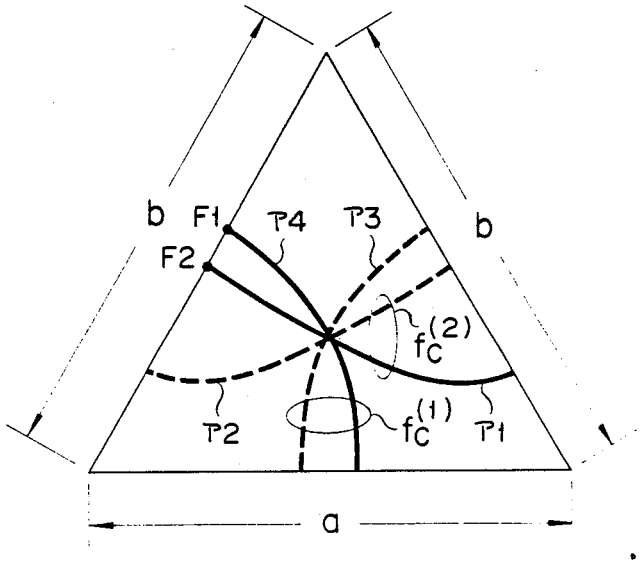
FIG. 10 shows the loci of the feed point of the microstrip antenna having an isosceles triangle radiator with a=76 mm, t=3.2 mm and $\epsilon_r$=2.55.

FIG. 10 shows a plan view of the radiator, as well as the loci $\Gamma_1$ to $\Gamma_4$ of the theoretical feed point obtained from Equation (23), where a=76 mm and b/a=0.98. In FIG. 10, $\Gamma_1$, $\Gamma_2$ show the loci when the CP operating frequency $f_c^{(2)}$ is 1583.8 MHz and $\Gamma_3$, $\Gamma_4$ show the loci when the CP operating frequency $f_c^{(1)}$ is 1564.2 MHz, noting that $\Gamma_1$, $\Gamma_4$ as indicated by the solid line correspond to RHCP and $\Gamma_2$, $\Gamma_3$ as indicated by the broken line correspond to LHCP. That is, when a feeding current of 1583.8 MHz is fed to one point on $\Gamma_1$, $\Gamma_2$, a CP wave of 1583.8 MHz is excited. On the other hand, when a feeding current of 1564.2 MHz is supplied to one point on $\Gamma_3$, $\Gamma_4$, a CP wave of 1564.2 MHz is excited.

Figure 11:
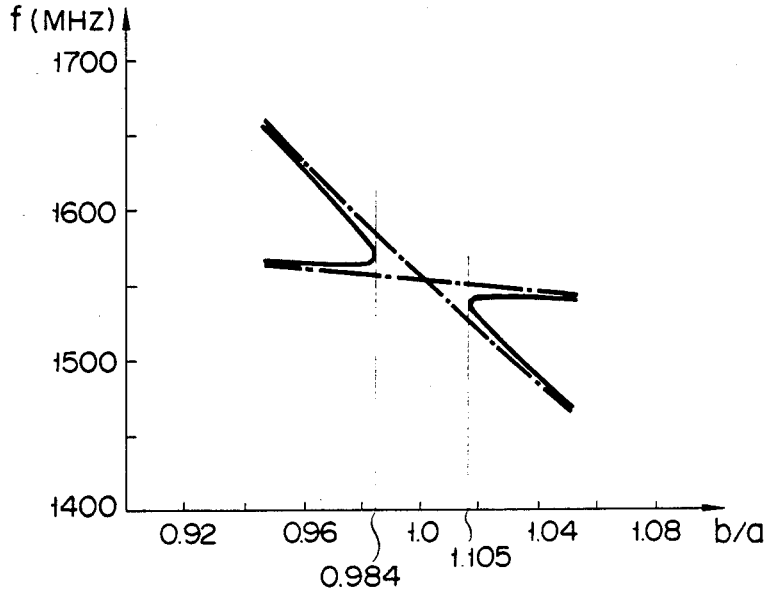
FIG. 11 is a graph showing a variation in the CP operating frequency when the antenna configuration of FIG. 10 is varied.

The solid line as shown in FIG. 11 shows a variation of CP operating frequency when b/a in FIG. 10 is varied, noting that the dot-dash line denotes the resonant frequencies of two modes contributing to the CP wave. From FIG. 11 it will be noted that CP waves are excited at two frequencies when b/a is smaller than 0.98 or greater than 1.11.

Figure 12A:
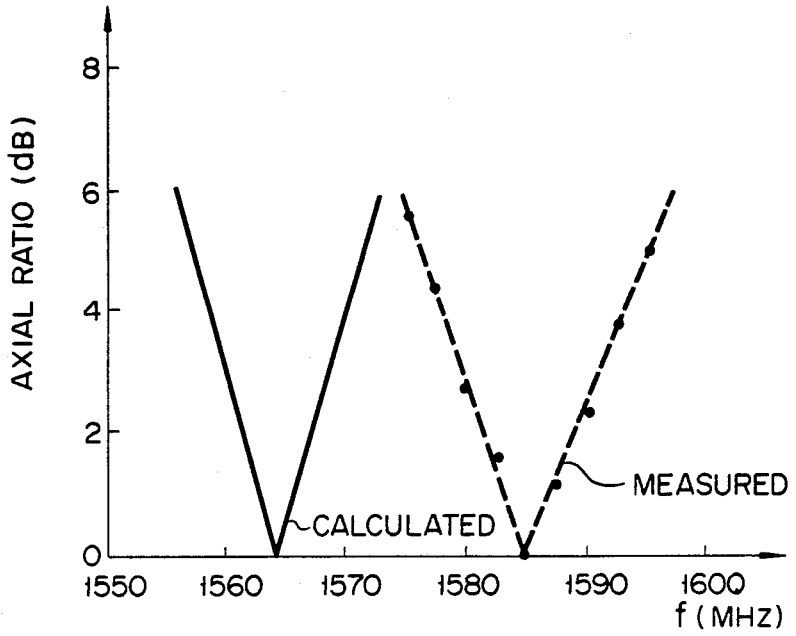
FIGS. 12A and 12B show the frequency characteristic of the antenna of FIG. 10 with respect to the axial ratio when the feed point is at F1 and F2.
Figure 12B:
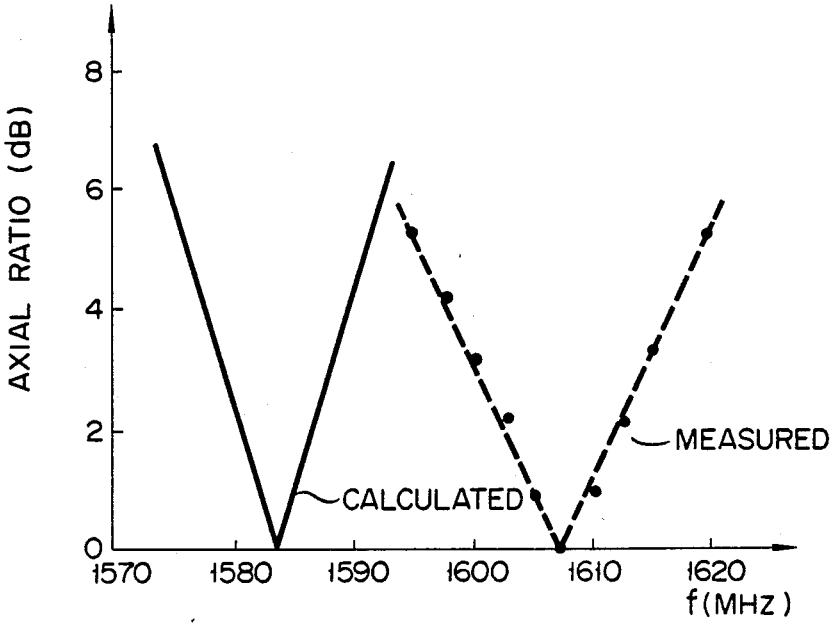

FIGS. 12A and 12B show the bore-sight axial ratio characteristic of the antenna in FIG. 10, noting that FIG. 12A corresponds to the case where one point F1 on the locus $\Gamma_4$ is defined as the feed point while FIG. 12B corresponds to the case where one point F2 on the locus $\Gamma_1$ is defined as the feed point. From these Figures it will be appreciated that, pure CP waves are excited. It is needless to say that such an axial ratio characteristic can be established not only at the points F1, F2 but also any point of $\Gamma_1$ to $\Gamma_4$. In this form of design, there is some case where, like the first form of design, the CP operating frequency and feed point need to be somewhat adjusted from the theoretical values.

Figure 13:
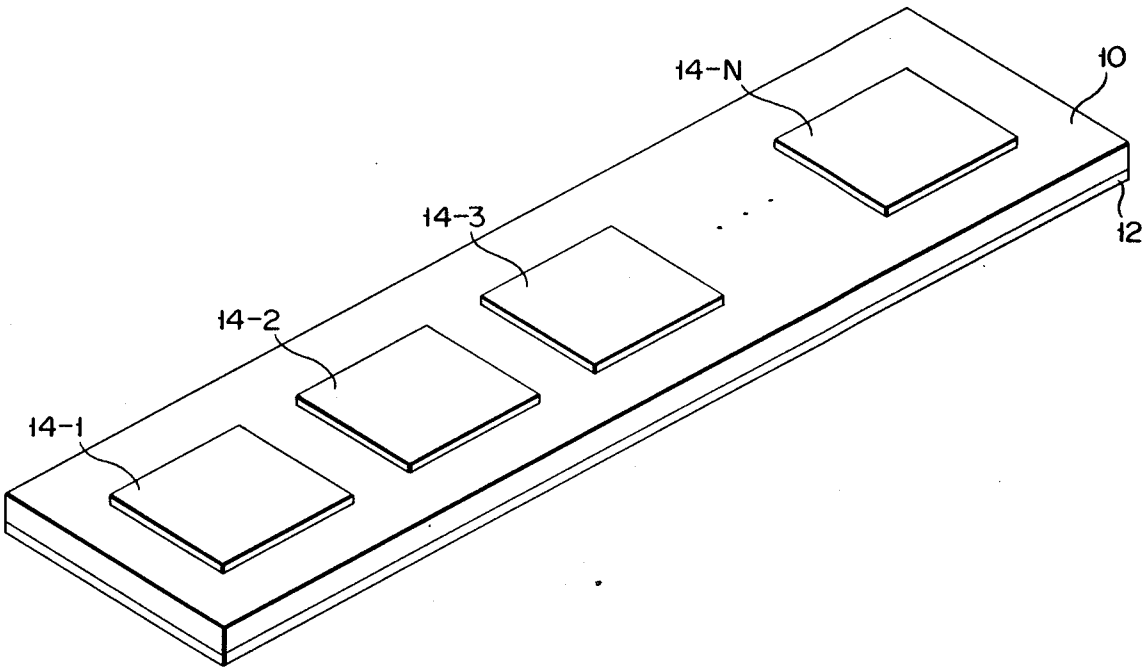
FIG. 13 is a perspective view of to an array antenna according to this invention.
Figure 7:
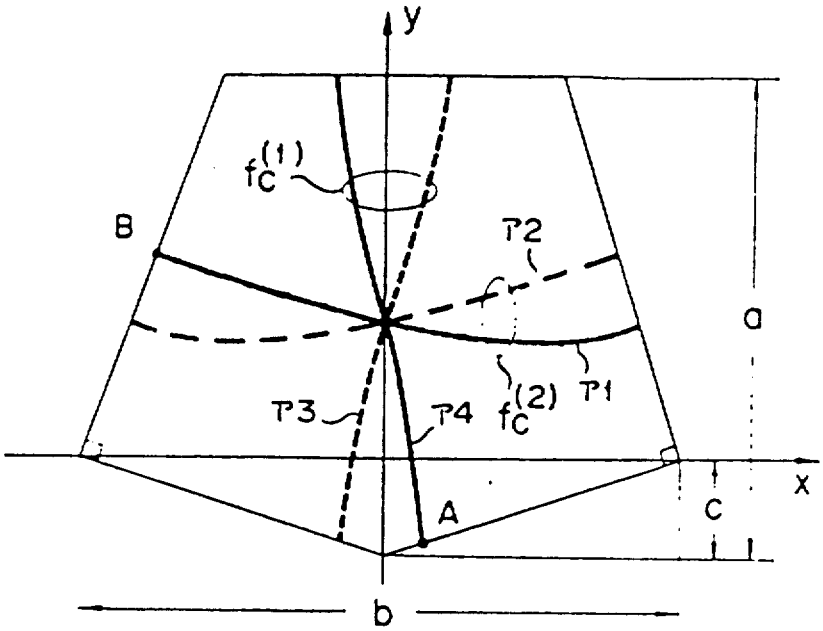

As set out above, a CP microstrip antenna of any configuration can be realized according to this invention, without depending upon the conventional conditions that the radiator has a linearly symmetrical configuration such as a circular or a square configuration and a feed point is located on two straight lines intersected at an angle of ±45° with respect to the symmetrical axis and at an equidistant point of the symmetrical axis. According to this invention, circularly polarized waves of different frequencies can be excited by varying the position of the feed point. A plurality of radiators 14-1, 14-2, . . . , 14-N are formed on a dielectric substrate 10 as shown in FIG. 13 to provide a microstrip array antenna. In this case, an electromagnetic wave can be transmitted and received at two different frequencies by varying the position of the feed points of these radiators. In the array antenna, the radiators may have a feed point at the same position and, in this case, the beams of the respective radiators are combined to produce a single composite beam.

What is claimed is:

1. A singly fed circularly polarized microstrip antenna comprising:

a dielectric substrate;

a conducting ground layer coated on one side of said dielectric substrate; and a conducting patch radiator coated on the other side of said dielectric substrate, the radiator having a feed point ($x_c$, $y_c$) which is a solution of the following equation $$\frac{\psi^{(\nu+1)}(x_o\ y_c)}{\psi^{(\nu)}(x_o\ y_c)} = \pm \frac{E_0^{(\nu)}(0,\omega_c)\cdot\hat{x}}{E_0^{(\nu+1)}(0,\omega_c)\cdot\hat{y}} \times \left\{\omega_c C - \frac{1}{\omega_c L^{(\nu+1)}}\right\} \quad (+: RHCP,\ -: LHCP)$$

where $\nu$, $\nu+1$ represent two orthogonal modes contributing a circularly polarized wave;

$\psi^{(\nu)}$ represents an eigenfunction with respect to a $\nu$-th mode determined by the dimensions of the radiator and which is a function with respect to the position (x, y);

$E_0^{(\nu)}(0, \omega_c)$ represents an electric field in a direction $\theta=0°$ with respect to the $\nu$-th mode;

C represents a capacitance component of an equivalent circuit parameter for a microstrip antenna;

$L^{(\nu)}$ represents an inductance component of an equivalent circuit parameter for a microstrip antenna; and $\omega_c$ is an exciting frequency which is a $(\mu+1)$-th solution of the following interative equation:

$$\omega_{\mu+1} = \sqrt{\frac{[\{(\omega^{(\nu)})^2 + (\omega^{(\nu+1)})^2\} - U^2(\omega_\mu)] \pm \sqrt{D(\omega_\mu)}}{2}}$$

where $D(\omega) = [\{\omega^{(\nu)} - \omega^{(\nu+1)}\}^2 - U^2(\omega)] \times [\{\omega^{(\nu)} + \omega^{(\nu+1)}\}^2 - U^2(\omega)]$, $$U(\omega) = \frac{\sqrt{g^{(\nu)}(\omega)\cdot g^{(\nu+1)}(\omega)}}{C},$$

$g^{(\nu)}(\omega)$: a conductance component of an equivalent circuit parameter for a microstrip antenna, which is a function with respect to $\omega$.

2. A singly fed circularly polarized microstrip antenna according to claim 1, in which said radiator has a linearly symmetrical configuration and a feed point is located on other than two straight lines intersected at an angle of ±45° with respect to a symmetrical axis and at an equidistant point of the symmetrical axis.

3. A singly fed circularly polarized microstrip antenna according to claim 2, in which said feed point is a point of loci determined according to an exciting frequency and the rotational direction of circularly polarized waves.

4. A singly fed circularly polarized microstrip antenna according to claim 3, in which said radiator has a substantially square configuration of a×b where a≠b but a≃b and can excite circularly polarized waves at two different frequencies, the loci of said feed point are in the vicinity of vertical bisecting lines drawn with respect to each side of the configuration, and the loci for right-hand and left-hand rotation circularly polarized waves at the respective frequencies are substantially symmetric with the vertical bisecting line as a center.

5. A singly fed circularly polarized microstrip antenna according to claim 3, in which said radiator has a pentagonal configuration and can excite circularly polarized waves at two different frequencies and the loci of the feed point are located on four curves which are symmetrical with respect to a symmetrical axis of the pentagonal.

6. A singly fed microstrip antenna according to claim 3, in which said radiator has an isosceles triangle configuration and can excite circularly polarized waves at two different frequencies, and the loci of the feed point are located on four curves which are symmetrical with respect to a symmetrical axis of the isosceles triangle.

7. A singly fed circlarly polarized microstrip antenna comprising:

a dielectric substrate;

a conducting ground layer coated on one side of said dielectric substrate; and a radiator array comprised of a plurality of conducting patch radiators, having the same shape, coated on the other side of said dielectric substrate, the radiators having the same feed point ($x_c$, $y_c$) which is a solution of the following equation $$\frac{\psi^{(\nu+1)}(x_o y_c)}{\psi^{(\nu)}(x_o y_c)} = \pm \frac{E_0^{(\nu)}(0,\omega_c)\cdot\hat{x}}{E_0^{(\nu+1)}(0,\omega_c)\cdot\hat{y}} \times \left\{\omega_c C - \frac{1}{\omega_c L^{(\nu+1)}}\right\} \quad (+: RHCP,\ -: LHCP)$$

where $\nu$, $\nu+1$ represent two orthogonal modes contributing a circularly polarized wave;

$\psi^{(\nu)}$ represents an eigenfunction with respect to a $\nu$-th mode determined by the dimensions of the radiator and which is a function with respect to the position (x, y);

$E_0^{(\nu)}(0, \omega_c)$ represents an electric field in a direction $\theta=0°$ with respect to the $\nu$-th mode;

C represents a capacitance component of an equivalent circuit parameter for a microstrip antenna;

$L^{(\nu)}$ represents an inductance component of an equivalent circuit parameter for a microstrip antenna; and $\omega_c$ is an exciting frequency which is a $(\mu+1)$-th solution of the following interative equation:

$$\omega_{\mu+1} = \sqrt{\frac{[\{(\omega^{(\nu)})^2 + (\omega^{(\nu+1)})^2\} - U^2(\omega_\mu)] \pm \sqrt{D(\omega_\mu)}}{2}}$$

where $D(\omega) = [\{\omega^{(\nu)} - \omega^{(\nu+1)}\}^2 - U^2(\omega)] \times [\{\omega^{(\nu)} + \omega^{(\nu+1)}\}^2 - U^2(\omega)]$, -continued $$U(\omega) = \frac{\sqrt{g^{(\nu)}(\omega) \cdot g^{(\nu+1)}(\omega)}}{C},$$

$g^{(\nu)}(\omega)$: a conductance component of an equivalent circuit parameter for a microstrip antenna, which is a function with respect to $\omega$.

8. A singly fed circularly polarized microstrip antenna comprising:

a dielectric substrate;

a conducting ground layer coated on one side of said dielectric substrate; and a radiator array comprised of a plurality of conducting patch radiators, having the same shape, coated on the other side of said dielectric substrate, some radiators having a feed point ($x_c$, $y_c$) which is one of solutions of the following equation, the other radiators having a feed point ($x_c$, $y_c$) which is the other solution of the following equation $$\frac{\psi^{(\nu+1)}(x_o y_c)}{\psi^{(\nu)}(x_o y_c)} = \pm \frac{E_0^{(\nu)}(0,\omega_c) \cdot \hat{x}}{E_0^{(\nu+1)}(0,\omega_c) \cdot \hat{y}} \times$$

$$\left\{ \omega_c C - \frac{1}{\omega_c L^{(\nu+1)}} \right\} \quad (+: RHCP,\ -: LHCP)$$

where $\nu$, $\nu+1$ represent two orthogonal modes contributing a circularly polarized wave;

$\psi^{(\nu)}$ represents an eigenfunction with respect to a $\nu$-th mode determined by the dimensions of the radiator and which is a function with respect to the position (x, y);

$E_0^{(\nu)}(0, \omega_c)$ represents an electric field in a direction $\theta=0°$ with respect to the $\nu$-th mode;

C represents a capacitance component of an equivalent circuit parameter for a microstrip antenna;

$L^{(\nu)}$ represents an inductance component of an equivalent circuit parameter for a microstrip antenna; and $\omega_c$ is an exciting frequency which is a $(\mu+1)$-th solution of the following interative equation:

$$\omega_{\mu+1} = \sqrt{\frac{[\{(\omega^{(\nu)})^2 + (\omega^{(\nu+1)})^2\} - U^2(\omega_\mu)] \pm \sqrt{D(\omega_\mu)}}{2}}$$

where $D(\omega) = [\{\omega^{(\nu)} - \omega^{(\nu+1)}\}^2 - U^2(\omega)] \times [\{\omega^{(\nu)} + \omega^{(\nu+1)}\}^2 - U^2(\omega)]$, $$U(\omega) = \frac{\sqrt{g^{(\nu)}(\omega) \cdot g^{(\nu+1)}(\omega)}}{C},$$

$g^{(\nu)}(\omega)$: a conductance component of an equivalent circuit parameter for a microstrip antenna, which is a function with respect to $\omega$.

* * * * *

UNITED STATES PATENT AND TRADEMARK OFFICE

CERTIFICATE OF CORRECTION

PATENT NO. : 4,564,842

DATED : January 14, 1986

INVENTOR(S) : Yasuo Suzuki

It is certified that error appears in the above-identified patent and that said Letters Patent is hereby corrected as shown below:

IN THE DRAWINGS:

Figure 7

Change line Γ 1 to solid line;

Change line Γ 2 to broken line both as shown on the attached.

Signed and Sealed this

Eleventh Day of December, 1990

*Attest:*

HARRY F. MANBECK, JR.

*Attesting Officer*

*Commissioner of Patents and Trademarks*